US005092596A

United States Patent [19]

Bucaria

[11] Patent Number: 5,092,596

[45] Date of Patent: Mar. 3, 1992

[54] PROFESSIONAL SPORTS STRATEGY GAME

[76] Inventor: Laurence J. Bucaria, 19 Claudette Cir., Framingham, Mass. 01701

[21] Appl. No.: 565,997

[22] Filed: Aug. 10, 1990

[51] Int. Cl.[5] ..... A63F 7/06; A63F 5/04

[52] U.S. Cl. ..... 273/93 R; 273/142 E; 273/93 C; 273/297; 273/146

[58] Field of Search ..... 273/93 R, 297, 93 C, 273/244, 142 R, 94 R, 142 A–142 G, 142 J–142 K

[56] References Cited

U.S. PATENT DOCUMENTS

| | | | |
|---|---|---|---|
| 431,727 | 7/1890 | Samuels | 273/93 R |
| 848,351 | 3/1907 | De Walt | 273/93 R |
| 863,758 | 8/1907 | Roberts | 273/93 R |
| 866,057 | 9/1907 | Patch | 273/93 R |
| 1,320,315 | 10/1919 | Clarke | 273/93 R |
| 1,447,335 | 3/1923 | Balcom | 273/93 R |
| 1,532,066 | 3/1925 | O'Connor | 273/93 R |
| 1,779,584 | 10/1930 | Brown | 273/297 |
| 2,490,737 | 12/1949 | Muthart | 273/93 R |
| 2,769,639 | 11/1956 | Seale | 273/93 R |
| 4,486,022 | 12/1984 | Dixon | 273/244 |

*Primary Examiner*—Edward M. Coven
*Assistant Examiner*—Steven B. Wong
*Attorney, Agent, or Firm*—Hamilton, Brook, Smith & Reynolds

[57] ABSTRACT

A parlor game is described which combines the strategic decision-making of managing a sports team with the financial management of owning a professional sports franchise. A baseball game is played using a wheel which is spun to simulate a pitch, and a ball tossed into the wheel to simulate a hitting attempt. A legend on the wheel aligned with the location in which the ball comes to rest in the wheel is read to establish the outcome of the hitting attempt. No hitting attempt results in balls and strikes being read from the wheel as indicated by an external indicator. Different legends on the wheel correspond to different skill levels assigned to players on the teams. Currency provided with the game is used to upgrade the skill level of players, and to buy and sell concessions and media ownership rights. A player on a team may be challenged on a particular play by a player on the opposing team, the skill level of each player determining the probability of that player's success in the challenge.

38 Claims, 4 Drawing Sheets

PROFESSIONAL SPORTS STRATEGY GAME

BACKGROUND OF THE INVENTION

Parlor games in the past have included sports-oriented strategy games, including those games directed towards the sport of baseball. Many of these games include a probability event generating device such as dice, cards or spinnable pointers. However, these games typically do not provide a realistic simulation due to the limited number of strategic decisions that can be made by participants in the game. Furthermore, the number of events and occurances in such a game are typically not equivalent to the number of events and occurances which arise in an actual team sporting event.

In addition to the limited events and strategic decisions allowed in such prior art sports games, the true nature of professional sports is not recreated in the prior art games, as these games are concerned only with events transpiring on the field. For example, the trials and tribulations involved in the successful ownership of a sporting team franchise are not considered.

SUMMARY OF THE INVENTION

In accordance with the present invention, a parlor game simulating a sporting event between two teams is provided, each team having players categorized in one of a plurality of skill levels. A wheel is mounted on a base such that the wheel may be spun relative to the base. The wheel has a plurality of angular sectors which are equally spaced about the wheel, and which extend outwardly from the center of the wheel to the wheels circumference. One of the angular sectors of the wheel is identified by an identifying means after a spinning of the wheel.

Located around an outer portion of the wheel is a plurality of concentric rings, M in number, where M is an integer such as 4. Each ring is of a different color and circumference. The color of each ring corresponds to one of the skill levels assignable to the players of the teams. The positioning of the rings is such that each ring is divided into a plurality of ring segments, N in number, where N is an integer such as 28. The segments of the rings are radially aligned such that one segment of each ring resides in each of the angular sectors of the wheel. Outer radial line segments along an outer portion of the wheel separate the ring segments. The outer radial line segments are radially in line on the wheel with inner radial line segments on an inner portion of the wheel. Both the inner radial line segments and the outer radial line segments designate the radial borders of the angular sectors.

Each ring segment bears a legend denoting a particular occurance involving one of the team players and which affects the progress of the game. After a spin of the wheel, a particular angular sector is identified by the identifying means as a result of the spin. The resulting occurance is read from the legend of the ring segment which is of the same color as the player involved, and which resides in the identified angular sector. In a preferred embodiment, the sporting event is a baseball game and the spinning of the wheel is equivalent to one pitch in the baseball game.

The wheel has a bowl-shaped portion tapered toward the center of the wheel in which receiving locations equidistant from the center of the wheel are equally spaced in a circular pattern. The spacing of the locations is such that one receiving location is in each angular sector of the wheel. In this embodiment the identifying means is a ball which when tossed into the bowl-shaped portion of the wheel, while the wheel is spinning, has an equal chance of coming to rest in any one of the receiving locations. The angular sector in which the ball comes to rest is the identified sector in which the appropriate ring segment is found.

With at least two participants playing the game, one participant spins the wheel to represent the pitching of a baseball. A second participant has the option of tossing the ball into the spinning wheel in an attempt to hit the pitch. When the ball comes to rest in the wheel, the appropriate ring segment is found by looking to the color ring corresponding to the skill level of the batter in the identified sector in which the ball comes to rest. The outcome of the hitting attempt is then read from the legend in that ring segment.

If the second participant does not toss the ball into the wheel, it is equivalent to a "taking of the pitch." An indicator is provided adjacent an outer portion of the wheel. If the pitch is "taken", the appropriate ring segment is found by looking to the color ring corresponding to the skill level of the pitcher on the team of the first participant. In that color ring, the appropriate ring segment is that which is in the angular sector designated by the indicator when the wheel comes to rest. A plurality of markings are dispersed among all ring segments to indicate a secondary resulting occurance which, in the preferred embodiment, are strikes. If the pitch is taken, and the resulting ring segments contains a marking, the pitch is a strike. Conversely, if the resulting ring segment has no marking, the pitch is a ball.

A preferred embodiment further comprises dice representing varied levels of skill which are used in challenging the skill of a player on one team against the skill of a player on an opposing team. Such a challenge is issued verbally by one team participant to another, and each participant rolls a die corresponding to the skill level of his player involved in the challenge. The comparative result of the dice being rolled indicates the success or failure of the challenge. The higher skill level dice are distinguishable from the lower skill level dice, and their use provides a higher probability of success than the lower skill level dice.

Also provided with the game are cards, each of which has, on one side, a legend denoting a particular occurance which affects the progress of the game. In a preferred embodiment, an additional ring is provided on the wheel, and a card is selected by a participant representing the offensive team if a hitting attempt results in a particular angular sector being designated. The appropriate sector for card selection is identifiable by indicia dispersed among the segments of the additional ring. The selection of a card is in addition to the result of the hitting attempt which is read from the appropriate color ring.

To allow financial control of a participants team, simulated currency is provided. It is used in controlling financial transactions in the game which, in turn, affect the progress of the game. A currency source represented by a fictitious Owner's Association acts as a central source for controlling the receipt and distribution of currency. Certain amounts of the currency may be paid to the Owner's Association by a participant representing a team to increase the skill level of a player on that team.

Further provided are game pieces denoting concessions which may be purchased by a team with currency paid to the Owners' Association by a participant. Ownership of a concession during the course of the game results in periodic distributions of currency from the Owners' Association to the team owning the concession. Game pieces representing radio and television ownership rights are also purchaseable from the Owners' Association in exchange for currency paid thereto by a game participant. Ownership of such rights also result in a periodic distribution of currency from the Owners' Association to the team owning the rights.

DETAILED DESCRIPTION OF THE PREFERRED EMBODIMENT

I. THE WHEEL

Figure 1:
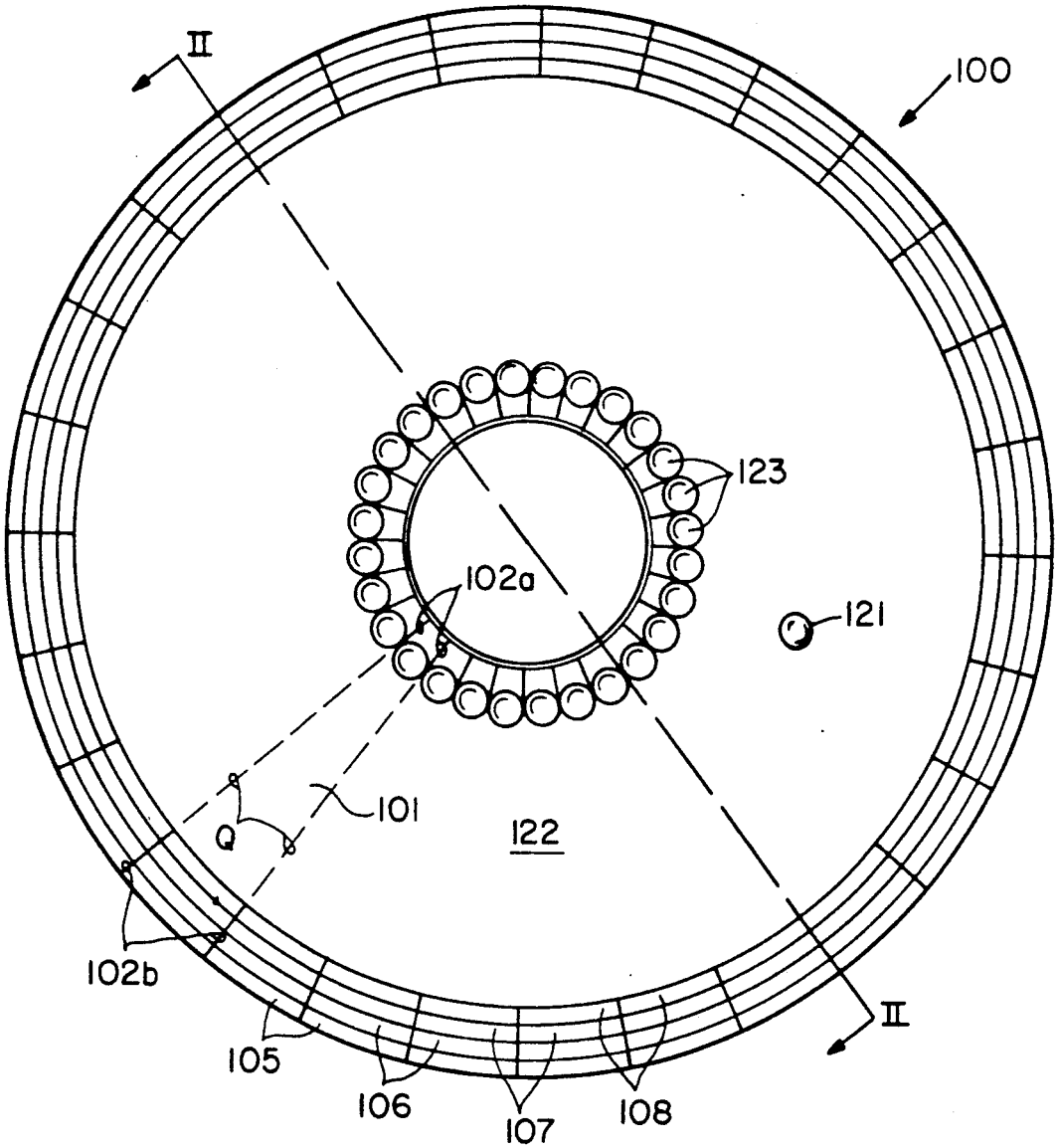
FIG. 1 is a plan view of a wheel used in accordance with the present invention.

Shown in FIG. 1 is a probability event generating device in the form of a wheel 100 which is partitioned into twenty-eight angular sectors 101 which are defined, in part, by radial connecting lines Q. Connecting lines Q indicate graphically one of the sectors 101 as designated by inner connecting radial line segments 102*a* and outer radial line segments 102*b*. Each sector 101 contains four ring segments 105, 106, 107, 108 of contrasting colors. Each of the ring segments is part of a different ring located along an outer portion of the wheel, all of the ring segments in a single ring being of the same color.

The outer segment 105 of each sector 101, colored red, represents both hitting and pitching potential of the highest level of skill. The second segment 106, colored white, represents potential of an intermediate level of skill; and the third segment 107, colored blue, represents potential of the lowest level of skill. It will be appreciated that where a particular color is designated, it is for illustrative purposes only and to distinguish the different ring segments of a particular angular sector from one another. The fourth inner segment 108 is part of an "event" ring which is comprised of segments having markings which indicate occurances which influence other aspects of the game and which are described hereinafter in further detail. Each segment combines with twenty-seven other segments of the same color to form complete rings around an outer portion of the wheel 100, each ring being of a different circumference.

Figure 2:
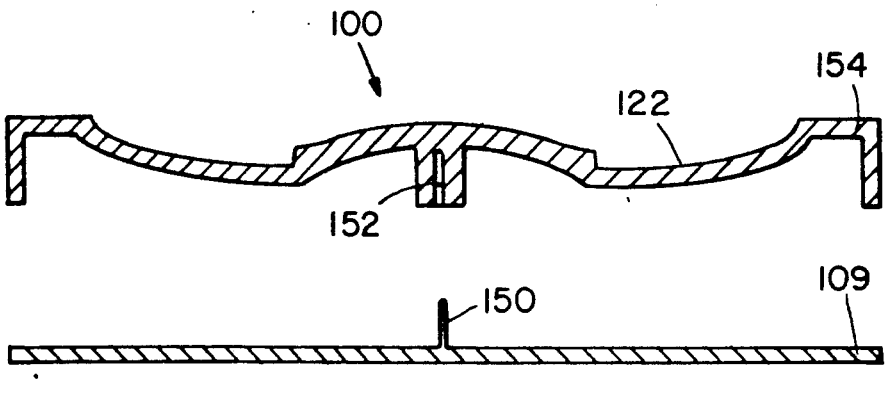
FIG. 2 is a cross section of the wheel of FIG. 1.

As shown in FIG. 2, The wheel 100 is a rotatable member and is mounted on a base 109 which allows the wheel to be spun manually by a participant in the game. The base 109 has a spindle 150 located at the center of the wheel. A bearing 152 is formed in the top, or exposed, portion 154 of the wheel 100. The bearing 152 is rotatably mounted on the spindle 150. A lubricant between the spindle 150 and the bearing 152 provides low friction between the two wheel portions.

II. PITCHING AND HITTING

To initiate an action in the game, the wheel 100 is spun by a participant representing the pitcher for the team currently on defense. The spinning of the wheel 100 is equivalent to the pitching of a baseball in an actual baseball game. If a participant representing the batter for the team on offense chooses not to swing at the pitch (i.e. not to attempt a hit), that participant takes no action, and the wheel is allowed to spin until it comes to rest.

Figure 3:
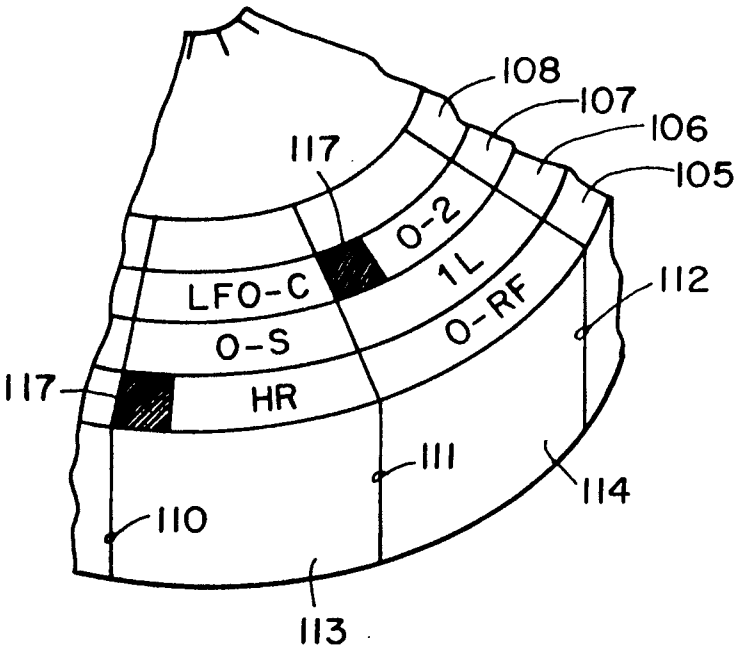
FIG. 3 is a cutaway view of the wheel of FIG. 1.

As shown in the cutaway of FIG. 3, the wheel 100 has vertical alternating red lines 110 and black lines 111 inscribed on the flat circumference 112 of the wheel 100. The zones 113, 114 formed between these red and black lines indicate which angular sector 101 of the wheel 100 is to be used to determine the outcome of the pitch (i.e. strikes and balls). A stationary indicator 119 (shown in FIG. 4) which points to the zones 113, 114 along the circumference of the wheel 100 is shaped like an extended replica of the home plate of a baseball diamond. When the wheel 100 comes to rest after a spin for which no hitting attempt is made, the indicator 119 points to one of the zones 113, 114. The angular sector 101 that is to be used to determine the outcome of the pitch is that sector to which the indicator 119 is pointing when the wheel 100 comes to rest. If the indicator 119 is pointing directly at a line when the wheel comes to rest, the zone to the left of the line is used if the line is a red line 110, while the zone to the right of the line is used if the line is black 111.

Figure 4:
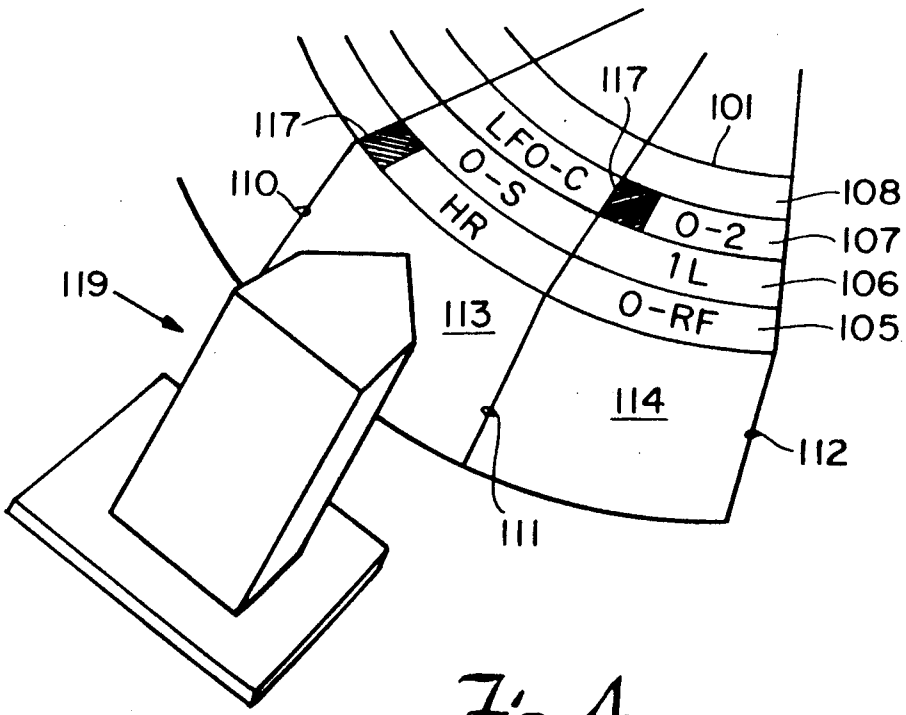
FIG. 4 is a view similar to FIG. 3 but including an indicator adjacent the wheel.

Each baseball team controlled by a participant ordinarily consists of nine different players, which are active in the game at a time. However, ten players may be used if a designated hitter rule is agreed to. In this instance one player on each team is a designated hitter who plays only on offense, and one player on each team is a pitcher who only plays on defense. Each of the team players has a particular skill level which is designated by the aforementioned colors red, white and blue. The skill level of the pitcher at the time the wheel is spun is used in determining the outcome of a pitch which is taken by the batter (i.e. when no action is taken on behalf of the offensive team after the wheel is spun). Once the wheel 100 comes to rest, the indicator 119 designates the angular sector 101 to be used, and the ring segment 105, 106, 107 in that sector of the wheel which matches the color of the pitcher is used to determine the outcome of the pitch. A black marking 117 (a square in the preferred embodiment) appearing on the left of the resulting segment indicates a strike, while the absence of a marking 117 indicates a ball. Examples of the presence and absence of such markings 117 in different colored segments is illustrated in FIGS. 3 and 4.

If the angular sector 101 corresponding to zone 114 in FIG. 3 was designated by the indicator 119 after spinning the wheel 100, then a pitcher having a blue skill level would pitch a strike, while a pitcher of a red or white skill level would pitch a ball. Similarly, the angular sector 101 corresponding to zone 113 was designated, then a pitcher of red skill level would pitch a strike while a pitcher of white or blue skill level would pitch a ball.

The dispersal of markings 117 on the ring segments 105, 106, 107 of the wheel 100 is such that each color ring represents a varying degree of skill in pitching. The red ring 105 has sixteen strikes (arcs with black squares) and twelve balls (arcs without black square markings 117) in its twenty-eight segments. Since there is equal probability of the wheel 100 designating any of the twenty-eight segments in a particular ring, a pitcher of the red skill level therefore has a 57% capability of throwing a strike. Similarly, since the pitcher of intermediate skill level has a white color designation, the outcome of pitches thrown by the intermediate pitcher are therefore read from the white ring segments 106 on the wheel 100. The white ring has twelve strikes and sixteen balls for a strike capability of 43%. A lower skill level pitcher has a blue designation, and the outcome of pitches thrown by this pitcher must be read from the blue ring segments 107, which the blue ring having eight strikes and twenty balls for a strike capability of 29%.

Once the participant representing the offensive team (and the batter) is ready, the wheel 100 is set in motion by the participant representing the defensive team (and the pitcher). At this point the participant on offense may elect to take the pitch by taking no action, as discussed previously, or may alternatively elect to attempt a hit. To attempt a hit, the participant on offense tosses or rolls a white ball 121 (shown in FIG. 1) in one direction in a tapered, bowl-shaped portion 122 of the wheel 100 until it comes to rest in one of twenty-eight counter sunk holes 123 near the center of the wheel 100. Each of the holes 123 is within one of the twenty-eight angular sectors 101 of the wheel 100. Within each colored ring segment 105, 106, 107 is a shorthand legend (as shown in FIGS. 3 and 4) indicating a possible hitting outcome. To determine the outcome of an attempted hit, participants look to the ring segments in the same angular sector as the hole in which the ball 121 comes to rest. The particular segment used is that which is the same color as the color designation of the batter. The outcome of the attempted hit is then read from the legend.

Of the legends in the red ring 105, nine of the potential outcomes are hits (out of twenty-eight segments) for a batting average of 0.320; in the white ring 106, seven of the twenty-eight ring segment legends denote hits, for a batting average of 0.250; and in the blue ring 107, five of the twenty-eight legends denote hits for a batting average of 0.180. It should be noted that the selection of strikes versus balls and hits per ring is preferable and specific to this embodiment, and could be changed without affecting the mechanics of play.

III. RUNNERS

In the course of an inning, the offensive team may have runners on base at the time the batter successfully hits the pitch. A game board, to be discussed hereinafter, has a representation of a baseball diamond with bases on which tokens designating baserunners may be placed. Baserunners advance on base hits by the batter according to their color designation. The color designation of a player remains the same when going from batter to baserunner. Blue baserunners advance the same number of bases as taken by the batter. White and red baserunners advance the number of bases taken by the batter, plus one extra base. One run is scored for each baserunner which reaches home plate on the game board. A scoreboard with changeable numbers may be provided to keep score for each inning as the game progresses.

IV. LEGENDS

The following is a list of typical legend symbols found on wheel 100 and the corresponding meanings of the symbols. The results of a hitting attempt (i.e. base taken or outs scored) are understood to be in accordance with the legends as defined below.

| LEGEND SYMBOL | MEANING |
|---|---|
| 1 C | single to center field |
| 1 R | single to right field |
| 1 L | single to left field |
| 2 C | double to center field |
| 2 R | double to right field |
| 2 L | double to left field |
| 3 C | triple to center field |
| 3 R | triple to right field |
| 3 L | triple to left field |
| H R | home run (field not specified) |
| F | foul |
| L F O-C | long fly out to center field |
| L F O-R | long fly out to right field |
| L F O-L | long fly out to left field |
| O S D P | Out to shortstop if no other baserunners are on base. Double play if runner(s) are already on base with lead runner and batter out. |
| O-1 | out to first baseman |
| O-2 | out to second baseman |
| O-3 | out to third baseman |
| O-S | out to shortstop |
| O-P | out to pitcher |
| O-CF | out to center fielder |
| O-RF | out to right fielder |
| O-LF | out to left fielder |

On any of the "long fly out" results (LFO-C, LFO-R, and LFO-L) a baserunner on second or third base may "tag up", thereby advancing to the next base. Challenges to outs and hits may also be made in accordance with the description below.

V. CHALLENGES

During the course of a game, challenges can be made by either game participant to match the skill of a particular player against the skill of a player of the opposing team. To engage in a challenge, the challenge is first verbally issued by one participant. The challenge is then carried out with the aid of challenge dice 142, 143, 144 (shown in FIG. 6). Die 142 is blue and has a dot on one of its six sides. The blue die must be used in representing a player of blue skill level. Die 143 is white and has a dot on each of two of its six sides. Die 143 is used to represent a player of white skill level. Die 144 is red and has a dot on each of three of its six sides. Die 144 is used to represent a player of red skill level. Two dice of each color are provided with the game.

When a challenge is made, each game participant takes a die of the color which corresponds to the color of the player on their team which is involved in the challenge. The participant issuing the challenge casts a die first, and if no dot appears face up on the die, the challenge is defeated. If, however, a dot appears, the participant being challenged must also throw his or her die, and must also have a dot appear to defeat the challenge. If the challenging participant throws a dot, and the participant receiving the challenge does not throw a dot, the challenge is successful.

When challenging, a participant may use a particular team player in a challenge, but only if that player and the nature of the challenge is appropriate to the given game situation. A list defining the rules of available challenges is provided with the game. The following is a list of challenges available in the preferred embodiment, and outcomes that result from successful and unsuccessful challenges. Indicated are the times at which such challenges are appropriate and which players of a participant's team can challenge which player's on the opposing team.

VI. CHALLENGE OPTIONS LIST

Option A Selection Conditions

Batter can challenge:

i. Pitcher—for being hit by a pitch. Successful challenge—batter takes 1st base and runners advance one base. Penalty for unsuccessful challenge—batter is out. Conditions when challenge can be made—any time.

ii. Fielders—for an error after an out results from a failed hitting attempt. Successful—hitter takes first base and all runners advance accordingly. Unsuccessful—double play with batter and lead runner out. Conditions—Fielder being challenged must be one of the fielders involved with making the play indicated by the legend on the wheel. This challenge cannot be made with more than one out. If no runners are on base, the next on deck batter is also out.

iii. Catcher—for third strike dropped. Successful hitter takes first base. Unsuccessful—batter and next on-deck batter out. Conditions—applies only when third strike is scored against the batter. Must be less than two outs.

Option B Selection Conditions

Pitcher can Challenge:

i. Base runner—in pick off attempt. Successful—runner out. Unsuccessful—all runners advance one base. Conditions—base runner to be challenged must be equivalent color or higher than pitcher.

Option C Selection Conditions

Infielders (first, second, third and shortstop) can challenge:

i. Base runner—in pick off attempt. Successful—runner out. Unsuccessful—all runners advance. Conditions—any time. Must be an infielder who covers the base on which the base runner is located or an infielder who covers the next base to which the baserunner could advance. Note: no color restrictions.

Option D Selection Conditions

Outfielders can Challenge:

i. Batter—on hits indicated by wheel. Successful—Batter out. Unsuccessful - Batter takes extra base and all runners advance accordingly. Conditions—any time hit is scored. Must be fielder in field designated by the wheel legend describing the hit.

Option E Selection Conditions

Catcher can Challenge:

i. Base runner—on pick off attempt—successful—runner out. Unsuccessful—all runners advance one base. Conditions—any time.

Option F Selection Conditions

Base runner can Challenge:

i. Infielder—for stolen base attempt—infielder being challenged must be appropriate for base being stolen. (e.g. second base attempt—can challenge catcher, shortstop or second baseman. Third base attempt—can challenge catcher, shortstop or third baseman. Home plate attempt—can challenge catcher, third baseman or pitcher). Successful—runner takes base. Unsuccessful—runner out. Conditions—any time runner on base.

ii. Pitcher—for balk. Successful—all runners advance one base. Unsuccessful—runner out. Conditions —any time runners on base.

Option G Selection Conditions

Manager can Challenge: (Note: Manager must use the color of the plurality of his team—nine man roster.)

i. Pitcher—for balk. Successful—all runners advance including batter. Unsuccessful—batter out. Conditions—any time.

ii. Pitcher—for wild pitch. Successful—all runners score if on second and/or third as first base runner goes to third. Unsuccessful—Batter out. Conditions—any time.

iii. Any infielder—for bunt attempt. Successful—batter awarded first base. Unsuccessful—batter out. Conditions—any time.

iv. Opposing manager for single, double or triple steal. Successful—all runners involved in steal advance one base. Unsuccessful—single steal attempt one out, double steal—two out, triple steal—three out. Conditions—attempts must be in line with number of outs left in inning.

v. Opposing manager—for sacrifice play. Successful—batter out but base runners advance. Unsuccessful—batter out plus lead runner. Conditions—no more than one out.

vi. Opposing manager—for squeeze play—same as in sacrifice but batter safe if successful. Conditions— there must be two strikes on the batter before the challenge can be made.

VII. PLAYING BOARD

Figure 5:
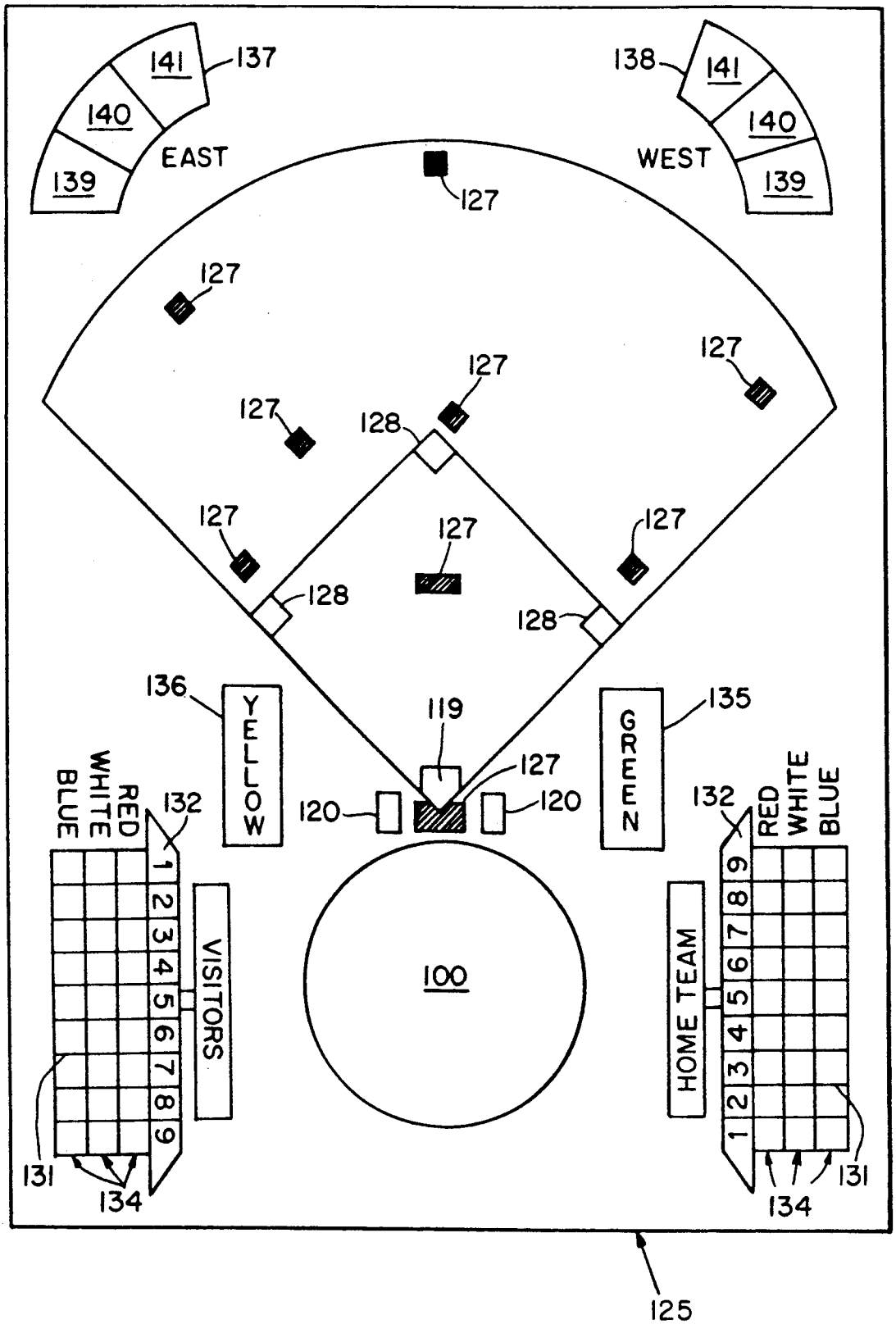
FIG. 5 is a plan view of a game board of the present invention.

A playing board 125 of the present invention is shown in FIG. 5, and represents an actual baseball playing field. The wheel 100 is placed behind home plate and the indicator 119 is placed in the home plate location and appears as an extension of home plate. Provision is made for tokens 129, 130 (FIG. 6) designating players to be placed in defensive positions identified by dark squares 127 on the board. Similarly, tokens for baserunners of the offensive team are positioned on the three bases 128 as necessary, while the batter token is positioned in the batter's box 120.

Figure 6:
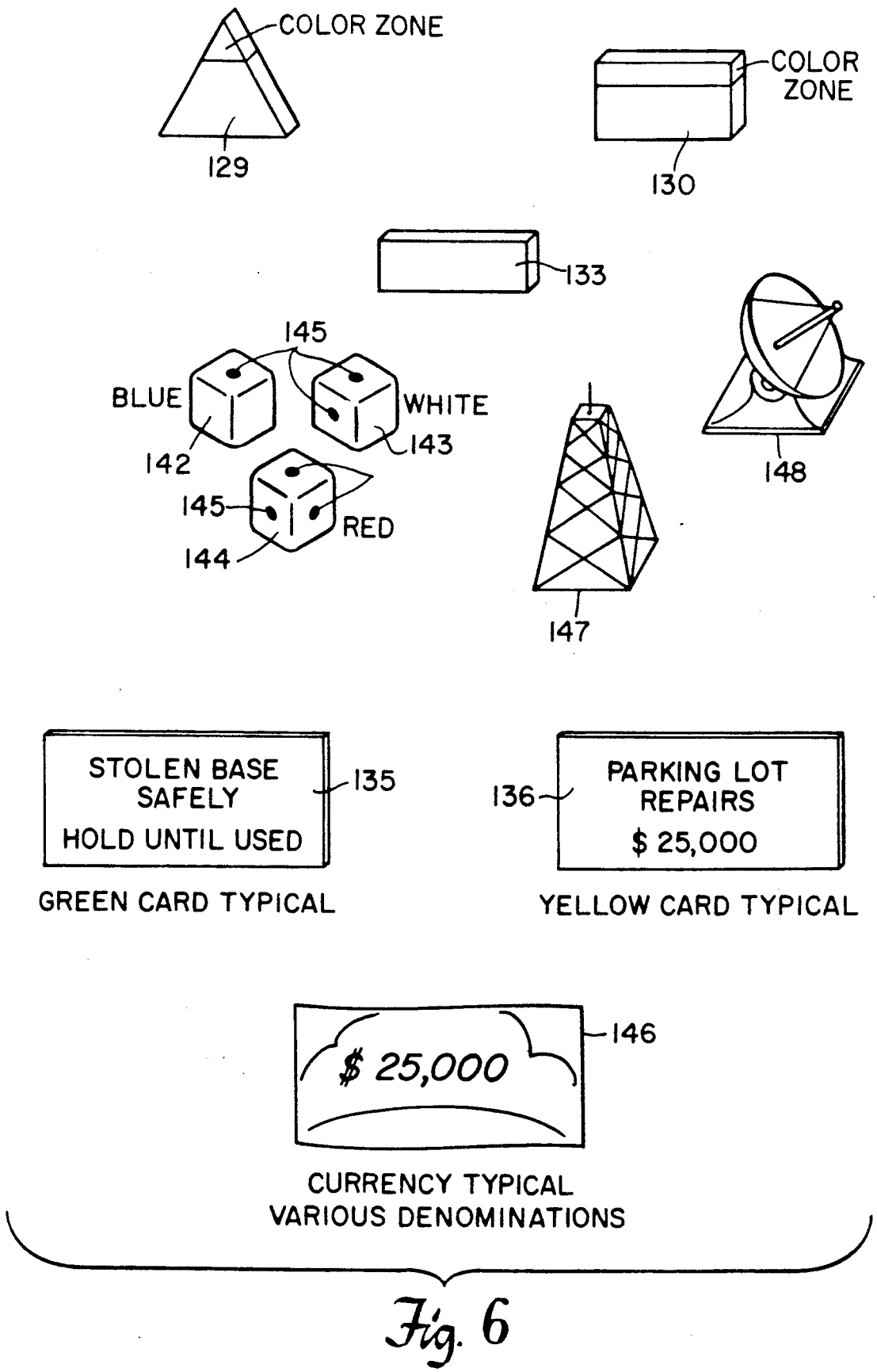
FIG. 6 is an illustration of game pieces, markers and tokens, dice, cards, and currency embodied in the present invention.

Opposing teams are represented by the differently configured tokens 129, 130 shown in FIG. 6. In the present embodiment, these tokens are squares 130 and triangles 129, respectively, so as to be easily distinguishable. Tokens for each player on a team are colored either red, white or blue to designate the skill level of each player. The tokens each have a shorthand legend denoting a field position. Thus, the game is provided with ten different tokens in each color skill level (each field position, plus a designated hitter token). This allows the nine or ten team players in the game to have any different combination of skill levels.

On the playing board 125 (FIG. 5) is depicted two dugouts 131, one on either side of the playing wheel. Each dugout is numbered sequentially from one to nine and serves to hold the line-up or batting order of the players of a team. In addition to the tokens 129, 130, nine markers 133 (FIG. 6) are provided with each team to indicate lineup position of each player in the dugout. The markers 133 are placed in the appropriate spaces in color bands 134 (red, white, or blue) of the dugout to designate the ability level of each batter. As each player comes to bat, the tokens for the offensive team are, one at a time, placed in the batter's box 120. If the batter gets on base, the token is then correspondingly moved to the appropriate base 128.

On either side of home plate on the playing board 125 are rectangular card storage locations which each hold one set of cards 135, 136. Cards placed in these locations are used during play of the game, and represent chance events similar to the chance events which sometimes occur in real life. One set of cards 135 is green and is always used during the game. On each green card is listed a different event which might occur within the baseball game itself, such as a double play or stolen base. The green cards 135 are intended to duplicate situations which could arise sporadically as the game progresses. The other set of cards 136 are yellow and deal with monetary aspects of the game to be described hereinafter.

The drawing of a card is dictated by the spin of the wheel 100. If the ball 121 tossed by the participant representing the batter comes to rest in a receiving location in the same angular sector as a ring segment 108 of the fourth ring which is a segment colored green, then the batter draws a green card. If the ball comes to rest in a angular sector which has a fourth ring segment 108 colored yellow, the batter draws a yellow card. The card drawing is performed in addition to the hitting attempt indicated by the legend of the appropriate segment, and the event indicated by the drawn card must be performed immediately, unless otherwise designated on the card. Alternate designations on the card may include the participant selecting the card being given the privilege of holding the card until it is advantageous to use it. An example of such a card is a green "Game called on account of rain" card, which allows a player holding the card to end the game upon presentation of the card. Presentation of the card prior to the completion of a required number of innings nullifies the game. Presentation of the card after the completion of the required number of innings causes a premature ending to the game, the winning team being the team with the highest score at the time the card is presented (if the home team is ahead, the required number of innings completed is 4½, if the visiting team is ahead 5 complete innings are required).

The foregoing description of the preferred embodiment of the present invention outlines the play with regard to the actual sports aspect of the game, and this portion of the game is referred to as "Managing Mode". The game may be played in managing mode, with the only concerns being the progress of the baseball game itself. However, in addition to the managing mode, the game may also be played in an "Ownership Mode", where controlling financial interests involved in the ownership of a professional sports team are also chief concerns of the game participants. Green cards 135 are used in both Managing Mode and Ownership Mode, but the yellow cards 136 are used only for Ownership Mode.

VIII. OWNERSHIP MODE

In the ownership mode, the participants act not only as managers of a baseball team, but also as owners of the baseball franchise represented by the team. Currency 146 (shown in FIG. 6) of various denominations is used to control the financial aspects of the game. At the beginning of the game, currency 146 ($300,000 in the preferred embodiment) is issued to each participant by a fictitious "Baseball Owners' Association". The currency may be used by the game participants to upgrade the skill level of players on their team, or to buy and sell concessions or broadcast rights. The transactions may occur between game participants, or between a game participant and the Baseball Owners' Association, which acts as a central currency source (a bank) to receive money for purchases of concessions and media rights, and to distribute currency to teams for different occurances during the game. Financial transactions may be initiated by the game participants, or may occur by chance as a result of an event in the course of the baseball game. The following is a list of rules regarding the generation of revenue in the financial mode of a preferred embodiment of the invention:

IX. RULES FOR REVENUE GENERATION

- o- All payments utilize the currency 146 provided with the game.
- o- Funds may be received or lost in accordance with the instructions on a drawn yellow card 136 (Losses include taxes, fines and other charges payable to the Owner's Association).
- o- Baseball Owner's Association (BOA) pays each team $300,000 at the beginning of the game. Additionally it pays a team $50,000 for each inning the opposition fails to score against it, paid at the conclusion of each inning.
- o- Defensive team pays the opposing team a $25,000 bonus for each run scored.
- o- Offensive team pays defensive team $25,000 for each three strikeout inning.
- o- $100,000 is paid to offensive team by defensive team for each grand slam scored against it (The $100,000 being in addition to the $25,000 for each run scored for a total of $200,000. A grand slam being a home run with the bases loaded).
- o- BOA pays $50,000 per inning to a team having radio rights ownership, $50,000 per inning for T.V. rights ownership. $150,000 per inning is paid for ownership of both.
- o- BOA pays $25,000 per inning to a team having ownership of each of three individual concessions available to each team. (One team may purchase the "East" concessions and the other team may purchase the "West" concessions). If a team owns all three concessions available to it, BOA pays $100,000 per inning.

A. Upgrade Fees

- o- A team must pay $50,000 to the BOA per individual upgrade from blue to white
- o- A team must pay $100,000 to the BOA per individual upgrade from white to red
- o- Penalty downgrades must begin at the highest level i.e. red to white. If no red then white to blue.

B. Concession Purchases

- o- Beverage, Deli and Pizza concessions may be purchased by a team from the BOA for $100,000 each, or at a reduced price as indicated on a selected yellow card.
- o- Concessions may be purchased from the BOA only when a participant representing a team on offense has a hitting attempt which results in an orange segment being designated on the inner ring.

C. Radio and Television Rights o- Radio and television rights may be purchased by a team from the BOA for $150,000 each.

o- Radio and television rights may be purchased from the BOA only upon selection of a yellow card indicating such.

D. Colored Ring Segments

On the innermost ring of the wheel, colored segments designate different financial consequences. In the preferred embodiment, the inner ring has one purple segment, four orange segments, two gold segments, one silver segments, four green segments and four yellow segments. The following list shows the consequences to the team at bat if the ball lands in the same angular sector as one of the colored fourth ring segments 108.

o- Purple - forfeit one concession to opposing team.

o- Orange - may purchase one concession. Upon refusal, opposing team may purchase for twice the price.

o- Gold - free $50,000 upgrade.

o- Silver - mandatory $50,000 downgrade (White to Blue). Note: if team has only red and blue players, one red becomes white.

o- Green - select green card.

o- Yellow - select yellow card.

Two groups of three replications of concession stands 137, 138 are adjacent to the right and left field areas of the board 125. Each group consists of a concession stand for dispensing pizza 139, a stand for soft drinks 140 and a delicatessen stand 141. In these locations are placed the concession tokens as they are purchased by a team. Radio and television tokens 147, 148 are shown in FIG. 6, and are placed on the board 125 near the concessions of a player owning the rights to that particular broadcast medium.

The following is a list of rules used for playing the game in either Managing Mode or Ownership Mode. These rules must be adhered to by all game participants during the course of the game.

X. PLAYING RULES - MANAGING MODE AND OWNERSHIP MODE

Batters must bat in order of their appearance in the lineup. Upgrades can only be made when team is at bat, prior to the first at bat.

Substitutions (upgrades) can be made while a team is at bat from players on the bench only to upgrade players already in the lineup.

Pitchers always bat as blue regardless of their color designation unless playing under designated hitter rules agreed to before the beginning of the game.

Red and white runners move two bases on a single. Blue runners move one.

All challenges must be made in accordance with the challenge option list.

Game can be nullified upon presentation of a green "game called because of rain" card if the required number of innings have not been completed Challenges can be made only once by any player during a particular play.

The beginning lineup for each team has one red, two white and six blue players.

The game is won by the team with the highest score at the completion of nine innings, or at the presentation of a green card stating "Game called on account of rain" if at least the required number of innings have been completed (extra innings may also be required if the score is tied at the end of nine innings).

Red die is thrown for home field advantage failure to throw dot loses.

All challenges are expressed verbally before being made.

Green cards and silver segments on the event ring are used during managing mode.

Players may be upgraded or downgraded in accordance with instructions on green cards while team is at bat.

One (blue to white) player upgrade allowed upon completion of a scoreless inning on defense.

One (blue to white) upgrade is allowed for each scoring inning by offense.

Mandatory downgrade of one player on the offensive team if the opposing pitcher strikes out the side.

Mandatory downgrade of one player on the defensive team if offense hits a grand slam.

The occurance of a gold fourth ring segment 108 mandates automatic upgrade of one player (blue to white).

The occurance of a silver fourth ring segment 108 mandates automatic downgrade of one player (red to white). Note: if no red to white downgrades are possible due to all blue players, then downgrade is white to blue.

XI ADDITIONAL RULES FOR OWNERSHIP MODE

Yellow cards are used in addition to green cards.

All revenue required for upgrades, purchase of concessions, payment of fines and various fees must be in accordance with the rules for revenue generation or by instruction specified on yellow cards.

The player who upgrades his entire roster to all red wins the game regardless of the score at the time of upgrade.

If a mandatory downgrade can not be performed due to all blue players, $50,000 must be paid to the BOA. Failure to do so forfeits the game.

Any amount due which cannot be paid forfeits the game.

A balance sheet is used with the game to keep track of the debits and credits of a team during the course of the game.

The preceding rules are particular to the preferred embodiment and may be changed or modified without substantially changing the nature of the game. While the invention has been particularly shown and described with reference to a preferred embodiment thereof, it will be understood by those skilled in the art that various changes in form and details may be made therein without departing from the spirit and scope of the invention as defined by the appended claims. In particular, the unique combination of ownership and managing (coaching) duties required of participants in the previously described baseball game could easily be implemented for similar games involving other professional sports. Basketball, football, hockey, and soccer are but a few examples of the types of professional sports which require both good coaching skills and good financial management. These sports would therefore also be good candidates for games akin to the baseball-oriented game demonstrated by the foregoing preferred embodiment.

I claim:

1. A game simulating a team sporting event between a first team and a second team each having players, each player being in one of a plurality of skill levels, the game comprising:

a rotatable member divided into N angular sectors;

first identifying means for identifying one of the angular sectors as a probabilistic result of rotating the member;

second identifying means for identifying one of the angular sectors as a probabilistic result of rotating the member; and M indicia positioned around the member, each indicia corresponding to one of the angular sectors and being divided into a plurality of segments, each segment of an indicia corresponding to a different one of said player skill levels and bearing a legend denoting a particular occurance which involves one of said team players and which affects the progress of the game, and whereby a game participant, for individual events during the game, selects either the first identifying means or the second identifying means for use in identifying one of the angular sectors, said particular occurance being read from the legend of a particular segment within the angular sector identified by the selected identifying means, said particular segment corresponding to the skill level of a particular one of said players, said particular player being on said first team if the first identifying means is selected and being on said second team if the second identifying means is selected.

2. A game according to claim 1 wherein each segment is part of a ring designating a particular player skill level, several of said rings of different circumference being located along an outer portion of the rotatable member, the segments being formed by the intersections of the rings and the angular sectors of the rotatable member.

3. A game according to claim 1 wherein the team sporting even being simulated is a baseball game.

4. A game according to claim 1 wherein the second identifying means comprises an indicator located adjacent an outer portion of the wheel to indicate one of the angular sectors when the member has stopped rotating.

5. A game according to claim wherein the rotatable member has a bowl-shaped portion tapered toward the center of the member in which receiving locations of the member are spaced in a pattern such that one receiving location is in each angular sector of the member, and wherein said first identifying means comprises a spherical ball which is released into the bowl-shaped portion and the angular sector identified by the first identifying means is the one containing the receiving location in which the ball is received.

6. A game according to claim 1 wherein the member is circular in shape, and N is at least 2 8 and M is at least 3.

7. A game simulating a team sporting event between a first team and a second team having players, each categorized in one of a plurality of skill levels, the game comprising:

a wheel mounted on a base which allows the wheel to be spun relative to the base, the wheel being divided into a plurality of equal angular sectors;

a first identifying means for identifying one of the angular sectors as a probabilistic result of spinning the wheel;

a second identifying means for identifying one of the angular sectors as a probabilistic result of spinning the wheel; and a plurality of concentric rings each of a different color and circumference positioned around an outer portion of the wheel, the color of each ring corresponding to one of said player skill levels, each ring being divided into a plurality of ring segments such that one segment of each ring is within one angular sector of the wheel, each ring segment bearing a legend denoting a particular occurance which involves one of said team players and which affects the progress of the game, an appropriate occurance being read from the legend of the ring segment which is of the color which corresponds to the skill level of a particular player involved, and which resides in the angular sector identified by a selected one of said identifying means, the selected identifying means being selected by a game participant representing the first team, said particular player involved being a player on the first team if the first identifying means is selected, and being a player on the second team if the second identifying means is selected.

8. A game according to claim 7 wherein said team sporting event being simulated is a baseball game.

9. A game according to claim 7 wherein the second identifying means comprises an indicator adjacent an outer portion of the wheel which indicates one of the angular sectors when the wheel is at rest.

10. A game according to claim 7 wherein the wheel has a bowl-shaped portion tapered toward the center of the wheel in which receiving locations equidistant from the center of the wheel are equally spaced in a circular pattern such that one receiving location is in each angular sector of the wheel, and wherein said first identifying means comprises a spherical ball which when tossed into the bowl-shaped portion of the wheel as the wheel is spinning quickly has an equal chance of coming to rest in any one of the receiving locations, the angular sector identified but he first identifying means being the one in which the ball comes to rest.

11. A game according to claim 10 wherein at least two participants play the game each representing one of the two opposing teams, a participant representing the second team spinning the wheel, and a participant representing the first team having the option of tossing the ball into the spinning wheel, and wherein selection of said first identifying means occurs when the participant representing the first team tosses the ball into the wheel.

12. A game according to claim 11 further comprising a plurality of markings dispersed among ring segments in addition to said legends which indicate a resulting occurance which is used when the ball is not tossed into the wheel.

13. A game according to claim 12 wherein the simulated team sport is baseball and the spinning of the wheel represents a pitch, while the tossing of the ball into the wheel represents a hitting attempt, and the legends on the ring segments denote results of a hitting attempt, while the markings dispersed among ring segments of the wheel each denote a particular pitching result.

14. A game according to claim 7 further comprising a plurality of dice representing varied levels of skill to be used in challenging the skill of one player against the skill of a player on the opposing team, the challenge being issued verbally by one game participant to another, the dice to be used by the game participants depending on the skill level of the players involved in the challenge, the dice used in representing a player of a higher skill level being distinguishable from the dice used for representing a player of a lower skill level and providing a higher probability of success than those used for representing a player of a lower skill level, the outcome of the challenge being determined by comparing the outcome of the dice rolled by the game participants.

15. A game according to claim 7 further comprising cards each of which has on one side a legend denoting a particular occurance which affects the progress of the game, the card being selected by a player in response to a particular angular sector of the wheel being identified as a result of a spinning of the wheel.

16. A game according to claim 7 further comprising simulated currency used in controlling financial transactions in the game which affect the progress of the game, a currency source being represented by a fictitious Owners' Association which acts as a central source for controlling the receipt and distribution of currency and privileges in the game.

17. A game according to claim 16 wherein amounts of said currency may be paid to the Owners' Association by a participant representing a team to increase the skill level of a player on a team.

18. A game according to claim 16 further comprising game pieces denoting concessions which may be purchased for a team with currency paid to the Owners' Association a game participant representing the team, ownership of a concession during the course of the game resulting in periodic distributions of currency from the Owners' Association to the game participant representing a team owning the concession.

19. A game according to claim 16 further comprising game pieces representing radio and television ownership rights, either of said rights being purchaseable for a team from the Owners' Association in exchange for currency paid thereto by a game participant representing the purchasing team, ownership of either of said rights resulting in periodic distributions of currency from the Owners' Association to the game participant representing the team owning the rights.

20. A game simulating a baseball game between two teams, each having a plurality of players, comprising:

a wheel mounted on a base which allows the wheel to be spun relative to the base, the wheel being divided into a plurality of equal angular sectors and having a bowl-shaped portion tapered toward the center of the wheel in which receiving locations equidistant from the center of the wheel are equally spaced in a angular pattern, each receiving location residing in a different angular sector, a spinning of the wheel by a first game participant representing a team currently on defense being equivalent to the throwing of a pitch by a identified pitcher on the defensive team;

a ball which when tossed into the bowl-shaped portion of the wheel, as the wheel is spinning, has an equal chance of coming to rest in any one of the receiving locations, a tossing of the ball into the wheel by a second game participant representing the team currently on offense, after the wheel is spun by the first participant, being equivalent to a hitting attempt by an identified batter on the offensive team;

an indicator adjacent an outer portion of the wheel and indicating a particular angular sector of the wheel when the wheel is at rest;

a ring positioned along the outer portion of the wheel concentric with the wheel and divided into equally spaced ring segments, each ring segment being in a different angular sector of the wheel, each ring segment further having a legend denoting a particular result of a hitting attempt, the appropriate result of a hitting attempt being read from the ring segment in the same angular sector as the receiving location in which the ball comes to rest; and a plurality of identical markings dispersed among a chosen percentage of the ring segments to determine the outcome of a pitch when the ball is not tossed into the wheel by the second game participant, the determination being such that if a marking is present in the ring segment in the region indicated by the indicator when the wheel comes to rest, the pitch is recorded as a strike, while the absence of a marking is recorded as a ball.

21. A game according to claim 20 further comprising a plurality of rings provided in addition to said ring such that all rings have a different circumference and are positioned along the outer portion of the wheel concentrically with the wheel and are divided into equally spaced ring segments with each ring segment of a particular ring residing in one of said angular sectors, each ring segment having a legend denoting a particular result of a hitting attempt, the rings each being of a different color, each color representing a different skill level, said skill levels being correspondingly assigned to players in the game during the course of the game, and said appropriate result of a hitting attempt being read from the ring segment in the color ring corresponding to the skill level of the batter and residing in the same angular sector as the receiving location in which the ball comes to rest.

22. A game according to claim 21 wherein if the ball is not tossed into the wheel, the ring segment used to determine the outcome of the pitch is that which is in the angular sector indicated by the indicator and the color ring corresponding to the skill level of the identified pitcher.

23. A game according to claim 20 further comprising a plurality of dice for use in challenging the skill of a player on one team against the skill of a player on the opposing team, such a challenge being issued verbally from one game participant to another and the rolling of the dice by game participants determining the outcome of the challenge, each game participant rolling a die which corresponds to the skill level of a player on their team involved in the challenge to represent that player in the challenge, the die used in representing a player of a higher skill level having a higher probability of success than a die used in representing a player of a lower skill level.

24. A game according to claim 20 further comprising an additional concentric event ring on the wheel having a ring segment in each of said angular sectors, ring segments of the event ring having indicia which indicate occurances that result in addition to the result of the hitting attempt, when the ball comes to rest in a receiving location in the same angular sector as a particular segment of the event ring.

25. A game according to claim 24 further comprising cards, each of which has on one side a legend which introduces a particular occurance into the game thereby affecting the progress of the game, a card being drawn by a participant when the ball comes to rest in the same angular sector as a particular segment of the event ring.

26. A game according to claim 20 further comprising simulated currency for use in making financial transactions in the game which affect the progress of the game, a central currency source being represented by a fictitious Baseball Owners' Association, the Owners' Association receiving and distributing money in the game.

27. A game according to claim 26 wherein a game participant representing a team may use said currency to change a skill level of a player on that team by paying a fixed sum to the Owners' Association.

28. A game according to claim 26 further comprising game pieces denoting concessions which may be purchased for a team with currency paid to the Owner's Association by a participant representing the team, ownership of the concession resulting in periodic distributions of currency from the Owners' Association to the game participant representing the team owning the concession.

29. A game according to claim 26 further comprising game pieces representing radio and television ownership rights, either of the rights being individually purchaseable from the Owners' Association in exchange for currency paid thereto by a game participant representing the purchasing team, ownership of the rights resulting in the Owners' Association paying periodic disbursements to the game participant representing the team owning the ownership rights.

30. A method of simulating a team sporting event between a first team and a second team having players, each player being categorized in one of a plurality of skill levels, the method comprising:

providing a rotatable member divided into "N" angular sectors;

providing a first identifying means for identifying one of the angular sectors as a probabilistic result of rotating the member;

providing a second identifying means for identifying one of the angular sectors as a probabilistic result of rotating the member;

selecting by a game participant, for individual events of the game, between use of the first identifying means and use of the second identifying means;

using the selected identifying means to identify a particular angular sector;

locating one of "M" indicia positioned around the member, each indicia corresponding to one of the angular sectors, the indicia to be located being that corresponding to said particular angular sector, each indicia being divided into a plurality of segments, each segment of an indicia corresponding to one of said player skill levels and bearing a legend denoting a particular occurance involving one of said team players which affects the progress of the game; and reading the legend of an appropriate segment and updating game status with the occurance denoted by the appropriate segment, the appropriate segment being that segment in the located indicia which corresponds to the skill level of a particular player involved in the occurance, said particular player being a player on the first team if the first identifying means is selected and being a player on the second team if the second identifying means is selected.

31. A method according to claim 30 wherein said team sporting event being simulated is a baseball game.

32. A method according to claim 30 wherein providing a rotatable member further comprises providing a rotatable member having a bowl-shaped portion tapered toward the center of the member in which receiving locations are spaced in a pattern such that one receiving location is in each angular sector of the member, and wherein providing a first identifying means comprises providing a spherical ball which is tossed into the bowl-shaped portion, the angular sector identified by the first identifying means being that containing the receiving location in which the ball comes to rest.

33. A method according to claim 32 wherein one game participant rotates the rotatable member, and another participant has an option of tossing the ball into the rotating member to select the first identifying means, and said second identifying means is provided in the form of an indicator located adjacent an outer portion of the member which indicates one of the angular sectors when the rotatable member stops rotating.

34. A method according to claim 33 further comprising providing a plurality of markings dispersed among the segments in addition to said legends which indicate a resulting occurance which is used when the ball is not tossed into the bowl-shaped portion.

35. A method according to claim 34 wherein the simulated team sport is baseball and the rotating of the rotatable member represents a pitch, while the tossing of the ball into the bowl-shaped portion represents a hitting attempt, the legends on the segments denoting the results of a hitting attempt, while the markings dispersed among the segments each denote a particular pitching result.

36. A method according to claim 30 further comprising resolving a verbal challenge issued by a first game participant to a second game participant, the challenge being a challenge of the skill of a player on a team represented by the first participant versus the skill of a player on a team represented by the second participant, each participant having a means of generating a probabilistic outcome, the generating means used by each participant being designated by the skill level of the player which the participant represents, the result of the challenge being one of a plurality of predetermined occurances which affect the progress of the game, the particular resulting occurance being determined by the probabilistic outcomes of the generating means used by each participant.

37. A method according to claim 36 wherein in resolving a challenge, the generating means used by a participant representing a player of higher skill level provides a higher chance of a result being favorable to that participant than if the generating means used is for representing a player of lower skill level.

38. A game simulating a baseball game between a first team and a second team having players each categorized in one of a plurality of skill levels, the game comprising:

a wheel mounted to a base which allows the wheel to be spun relative to the base, the wheel being divided into a plurality of equal angular section;

a first identifying means for identifying one of the angular sectors as a probabilistic result of spinning the wheel;

a second identifying means for identifying one of the angular sectors as a probabilistic result of spinning the wheel; and a plurality of concentric rings each of a different color and circumference positioned around an outer portion of the wheel, the color of each ring corresponding to one of said player skill levels, each ring being divided into a plurality of ring segments such that one segment of each ring is within one angular sector of the wheel, each ring segment bearing a legend denoting a particular occurance which involves one of said team players and which affects the progress of the game, an appropriate occurance being read from the legend of the ring segment which is of the color which corresponds to the skill level of a particular pitcher or batter involved, and which resides in the angular sector identified by a selected on of the identifying means, the selected identifying means being selected by a game participant representing the first team, said particular player being a batter on the first team if the first identifying means is selected, and being a pitcher on the second team if the second identifying means is selected.

* * * * *

UNITED STATES PATENT AND TRADEMARK OFFICE

CERTIFICATE OF CORRECTION

PATENT NO. : 5,092,596

DATED : March 3, 1992

INVENTOR(S) : Laurence J. Bucaria

It is certified that error appears in the above-identified patent and that said Letters Patent is hereby corrected as shown below:

Col. 13, line 1, after "being" insert ---categorized---.

Col. 13, line 38, delete "even" and insert ---event---.

Col. 13, line 43, after "claim" insert ---1---.

Col. 13, line 54, delete "2 8" and insert ---28---.

Col. 14, line 38, delete "but he" and insert ---by the---.

Col. 18, line 58, delete "section" and insert ---sectors---.

Col. 20, line 2, delete "on" and insert ---one---.

Signed and Sealed this

Twenty-ninth Day of June, 1993

Michael K. Kirk

*Attest:*

MICHAEL K. KIRK

*Attesting Officer*

*Acting Commissioner of Patents and Trademarks*